United States Patent [19]

Goettl

[11] 4,361,522

[45] Nov. 30, 1982

[54] AUTOMATIC FLUSHING AND DRAINING APPARATUS FOR EVAPORATIVE COOLERS

[76] Inventor: Adam D. Goettl, 4960 E. Palomino Rd., Phoenix, Ariz. 85018

[21] Appl. No.: 313,727

[22] Filed: Oct. 22, 1981

Related U.S. Application Data

[63] Continuation-in-part of Ser. No. 296,775, Aug. 27, 1981, Pat. No. 4,333,887, which is a continuation-in-part of Ser. No. 222,552, Jan. 5, 1981, Pat. No. 4,289,713, which is a continuation-in-part of Ser. No. 115,041, Jan. 24, 1980, Pat. No. 4,225,361, which is a continuation-in-part of Ser. No. 7,027, Jan. 29, 1979, Pat. No. 4,192,832.

[51] Int. Cl.[3] ..... B01F 3/04

[52] U.S. Cl. ..... 261/66; 137/132; 137/143; 137/468; 236/44 C; 261/26; 261/36 R; 261/97; 261/DIG. 34; 261/DIG. 46

[58] Field of Search ..... 261/26–29, 261/36 R, 70, 97, 92, 66, DIG. 3, DIG. 4, DIG. 11, DIG. 15, DIG. 34, DIG. 46; 62/171, 310, 315, DIG. 16; 137/101.27, 132, 135, 142, 143, 150.5, 468; 236/44 C

[56] References Cited

U.S. PATENT DOCUMENTS

| | | | |
|---|---|---|---|
| 545,566 | 9/1895 | Wrigley | 137/143 X |
| 2,580,826 | 1/1952 | Osburn et al. | 261/DIG. 46 |
| 2,646,061 | 7/1953 | Bottum | 261/DIG. 46 |
| 2,762,202 | 9/1956 | Ponsar | 137/132 X |
| 2,828,761 | 4/1958 | Weibert, Jr. | 261/36 R X |
| 2,856,166 | 10/1958 | Goettl | 261/29 |
| 3,265,371 | 8/1966 | McGrath | 137/143 X |
| 3,332,672 | 7/1967 | Schipper | 261/DIG. 46 |
| 3,643,930 | 2/1972 | Schulze, Sr. | 261/DIG. 46 |
| 3,867,485 | 2/1975 | Yeagle | 261/DIG. 46 |
| 4,129,140 | 12/1978 | Carlin | 261/DIG. 46 |

*Primary Examiner*—Richard L. Chiesa

*Attorney, Agent, or Firm*—Herbert E. Haynes, Jr.

[57] ABSTRACT

Apparatus for periodically draining, flushing and replacing the operational water supply in an evaporative cooler during operation thereof and for completely draining the cooler when its operation is terminated. The apparatus includes a special siphon drain valve mounted in the sump of the cooler so as to be normally in an unprimed non-siphoning state and when in such a state, the evaporative cooler will operate in the normal manner. When the cooler is in normal operation, its water supply will increase in mineral salt concentration and other contaminants, such as dirt, bacteria and the like. At periodic intervals, such as under the control of a time clock, a normally closed solenoid operated valve is momentarily actuated from its normally closed state to an open state which directs water under pressure to an injector device associated with the siphon drain valve, and the injector device directs the received water under pressure into the siphon drain valve which causes positive priming thereof to switch it to its siphoning state which drains the water supply from the cooler. The usual make-up water supply device of the evaporative cooler will operate so that the incoming fresh water will dilute the draining water and will thus flush the sump. The drainage flow rate is greater than the flow rate of the incoming fresh water, thus, when the drainage is completed, the siphon drain valve will automatically loose its prime, which allows the sump to be refilled with incoming fresh water. The apparatus may also include a water evaporation rate sensor which increases the frequency rate of the operation of the apparatus when the water evaporation rate of the cooler decreases below a predetermined rate. To accomplish cooler drainage at the termination of cooler operation, the apparatus is operated in the same manner with the cooler's fresh water make-up device being shut off, so that the drained water supply will not be replaced.

26 Claims, 11 Drawing Figures

AUTOMATIC FLUSHING AND DRAINING APPARATUS FOR EVAPORATIVE COOLERS

CROSS-REFERENCE TO RELATED APPLICATIONS

This application is a Continuation-in-Part of a copending U.S. patent application Ser. No. 296,775, filed Aug. 27, 1981, which issued as U.S. Pat. No. 4,333,887 on June 8, 1982, which is a Continuation-in-Part of a copending U.S. patent application Ser. No. 222,552, filed Jan. 5, 1981, which issued as U.S. Pat. No. 4,289,713, on Sept. 15, 1981, which is a Continuation-in-Part of U.S. patent application Ser. No. 115,041, filed on Jan. 24, 1980, which issued as U.S. Pat. No. 4,255,361, on Mar. 10, 1981, which is a Continuation-in-Part of copending U.S. patent application Ser. No. 007,027, filed Jan. 29, 1979, which issued as U.S. Pat. No. 4,192,832, on Mar. 11, 1980, all by the same inventor.

BACKGROUND OF THE INVENTION

1. Field of the Invention

This invention relates to evaporative coolers and more particularly to an improved automatic flushing and draining apparatus for use with evaporative coolers.

2. Description of the Prior Art

All evaporative coolers of the type having an air handler mounted in the cabinet for drawing air into the cooler through wettable cooler pads and delivering the evaporatively cooled air to a point of use, have the necessary water supply contained within a floor pan or sump. The water level within the sump is maintained at a predetermined level by a float controlled inlet valve that is suitably connected to a source of water under pressure, such as a municipal water line.

The most common type of evaporative cooler in use today employs a pump which is mounted in the sump of the cooler and operates to supply water to the cooler's water distribution system, which in turn distributes the water to the top of the cooler pads. The water trickles down through the cooler pads and the air being drawn therethrough by the air handler is cooled by the well known evaporative principle, and the unevaporated water drains, under the influence of gravity, from the pads back into the sump.

Another type of evaporative cooler which, although is not as common as the above described type, is gaining commercial acceptance, and will hereinafter be referred to as a pumpless cooler for reasons which will become apparent as this description progresses. In this pumpless type cooler, each of the pads of the cooler are of endless belt-like configuration and are carried on a pair of vertically spaced horizontally extending rollers, one of which is rotatably driven by a suitable electric motor, so that the pad is continuously moving over the rollers. The lowermost rollers of each pair of rollers are located in the cooler's sump so that the pads will be continuously driven through the water contained in the sump and are thus kept in a wetted state.

During operation of either of the above described pump-type or pumpless type evaporative coolers, the water, which inherently contains minerals, such as sodium and calcium chlorides and other impurities, will increase as to its concentration of those minerals due to the evaporation process. As the mineral concentration increases, the rate of precipitation will also increase which results in mineral deposits, or scaling, of the various cooler components. Such mineral deposition causes calcification of the cooler pads, clogging of the water passages, corrosion of the metal and the like, but the most serious problem is with the electric motors and wiring. When the mineral salts, which are electrovalent compounds, are deposited on the wiring terminals, and the various parts of the electric motors themselves, they attack those components and cause premature failures. Further, those compounds are hygroscopic in nature and will thus attract moisture out of the atmosphere even when the evaporative cooler is inoperative, and thus, salt induced deterioration is a continuing process. To keep such mineral deposits to a minimum, the cooler should be periodically drained, flushed, and refilled with fresh water. However, since such draining, flushing and refilling is something which should be accomplished on a regular and a rather frequent schedule, as determined by the characteristics of the water, it is something that is almost always forgotten, or simply ignored.

The above described problems of mineral deposition is compounded by the fact that the water is stored within the sump which serves as a reservoir. Thus, the various cooler components are exposed to a relatively large body of water in the bottom of its cabinet. Unless the sump is drained at the end of a cooling season, or prior to other periods of nonuse, such direct exposure of the components to the water body is something that can, and often is, continuous whether the cooler is operating or not.

The above described problems and shortcomings of prior art evaporative coolers is something that has long been recognized and various attempts have been made to solve, or at least, minimize some of those problems. For example, devices which dispense chemicals into the water to reduce mineral concentration and deposition problems have been suggested, however, such devices have not received widespread commercial acceptance due to the minimal and sometimes questionable benefits derived, cost, and the maintenance requirements.

In addition to the mineral build-up problem, other contaminants will collect in the water supply of evaporative coolers due to the air washing effect which results from drawing air through the wet cooler pads. Airborne pollen, dust, and the like, will be washed out of the ambient air as it passes through the cooler pads into the cooler, and those contaminants will be carried by the water back into the cooler's operating water supply. Those contaminants are detrimental to cooler life and efficient cooler operation, and, of course, a major concern relating to such airborne contaminants is bacteria. Airborne bacteria, which is washed from the incoming air into the cooler's water supply, and bacteria from other sources, is responsible for musty, or fishy odors coming from the cooler and delivered to the point of use by the air coming from the cooler. Further, such bacteria is responsible for fungi, algae and other thallophyta growths, which can, and very often occur in evaporative coolers.

One particular prior art device has been suggested in U.S. Pat. No. 2,828,761, for automatically draining, flushing, and replacing the water in the sump of a pump-type evaporative cooler and for draining a large portion of the water therefrom when the inlet water supply to the sump is shut off. Briefly, this prior art device includes a sheet metal dam which is located within the sump of the cooler. A oneway check valve is located in the wall of the dam so that water is free to flow from the main reservoir portion of the sump into the relatively smaller dam portion but is prevented from flowing in a reverse direction. A pump and siphon valve are located inside the dam and a float controlled water inlet valve is located in the main reservoir portion of the sump to maintain the water level in the sump and in the dam, due to the free flow through the checking valve, at a predetermined level. During operation of the cooler, the pump delivers water from within the dam portion to the cooler's water distribution system which in turn supplies water to the cooler pads, and the unevaporated water will return from the pads, by gravity, to the main reservoir portion of the sump. When the pump is turned off, water in the cooler's water distribution system will drain back into the dam area only, due to the reverse flow checking provided by the check valve, thus raising the water level therein to a point where it primes the siphon valve. When the siphon valve is so primed, water in the dam will be drained therefrom and the water in the main reservoir portion of the sump will flow through the check valve into the dam and will exit the dam through the siphon valve. When the water supply is left on during such an operation, the result is that a draining, flushing and water replacement action takes place, and due to the outlet and siphon drain valve being sized to drain the sump at a faster rate than the water inlet line can replace the water, the water level will drop until the siphon valve looses its prime, whereupon refilling of the sump with fresh water takes place under control of the float operated inlet valve. This same operation occurring when the water supply to the cooler is shut off results in draining of most of the water from the sump.

This particular prior art flushing and draining device has not received commercial acceptance for several reasons. In the first place, the amount of water contained in the water distribution plumbing system of an evaporative cooler is quite small and will, in many cases, be insufficient to achieve priming of the siphon valve. Secondly, the check valve of this prior art structure is a constant source of problems, in that the water pressure differential on the opposite sides thereof is all that can be relied upon for opening and closing of the valve, and that pressure differential is exceedingly small. The small pressure differential relied upon to open and close the check valve precludes the use of a spring or other device to bias the valve towards its closed position. Therefore, the check valve is a passive rather than a positively acting device, and achieving a fully closed position when such a state is critical is oftentimes not achieved. To illustrate this point, there can be no leakage through the check valve when the draining cycle is initiated, in that such leakage would prevent the water level in the dam from reaching the point where the siphon valve is primed. In addition to the passive action of the check valve, it by necessity, is operated under water and this subjects the valve to corrosion, mineral scaling, and the like, and the valve is often jammed by foreign matter such as dirt, wood shavings from the excelsior pads, and the like. Thirdly, this prior art device is incapable of completely draining all of the water from the dam and the main reservoir portion of the sump, in that both the check valve and the inlet to the siphon valve are spaced upwardly from the bottom of the sump. Therefore, the desirability of draining the sump when the cooler is inoperative cannot be completely achieved.

Therefore, a need exists for a new and improved automatic flushing and draining apparatus for evaporative coolers which overcomes some of the problems and shortcomings of the prior art.

SUMMARY OF THE INVENTION

In accordance with the present invention, a new and improved automatic flushing and draining apparatus for evaporative coolers is disclosed. The apparatus includes a special siphon drain valve and means for positively priming the siphon drain valve at predetermined intervals to switch the cooler from its normal operating mode to either of two draining operational modes.

The first draining operational mode is employed at predetermined intervals during operation of the cooler to drain the contaminated water from the sump, flush the sump and refill it with fresh water.

The second draining operational mode is employed to drain the water supply from the cooler's sump without replacement thereof upon termination of cooler operation, so that it will not contain a standing body of water during a non-use period.

The special siphon drain valve of the apparatus of the present invention is located in the sump of the cooler and has its inlet end disposed proximate the bottom of the sump. The outlet end of the siphon drain valve passes through the bottom of the sump and is provided with means by which a suitable water disposal line may be coupled thereto. The upper end, or water passage zone, in the siphon drain valve is located above the water level of the sump, so that the siphon drain valve will be normally in its unprimed state. The inlet end of the siphon drain valve is provided with injector means for receiving water under pressure and injecting it toward the upper end, or water passage zone, of the siphon drain valve to flood that zone and thereby positively prime the siphon drain valve.

The injector means provided on the inlet end of the siphon drain valve is coupled to receive water under pressure at predetermined intervals from the means for positively priming the siphon drain valve. In the preferred embodiment, the positive priming means includes a container which is coupled to receive water under pressure from a suitable source thereof, such as a domestic water supply pipeline. The container is provided with an anti siphon valve means to prevent the water supply of the cooler from being siphoned back into the water supply pipeline and is configured to store a relatively large quantity of water under pressure. The container has an outlet pipeline which is coupled to the injector means of the siphon drain valve and that outlet line has a normally closed solenoid operated shutoff valve therein. When the solenoid operated shutoff valve is energized, a relatively large quantity of water under pressure will flow from the container to the injector means for positively priming the siphon drain valve. Deenergization of the solenoid drain valve to its normally closed state will allow the container to refill with water, so that it will be ready for the next time the solenoid operated shutoff valve is energized.

The solenoid operated shutoff valve may be manually energized to accomplish the above described positive priming of the siphon drain valve. However, it is preferred that operation of the solenoid operated valve be under control of a suitable timing means to insure operation of the apparatus at reliable and predictable predetermined time intervals.

The timing means may be in the form of a conventional time clock which is configured to energize the solenoid at predetermined time intervals. The timing means may also include means for sensing the rate of water evaporation in the cooler and respond to a decrease in the evaporation rate by increasing the frequency of sump drainage to insure against bacteria build-up within the cooler's sump.

From the above description, it will be seen that the apparatus of the present invention is utilized to perform a beneficial function in evaporative coolers but, the apparatus does not rely on any component or operational occurrence of the cooler itself to accomplish that function. In other words, the apparatus of the present invention is completely self-sufficient, in that it does not require that its operation be triggered by interruption of the cooler's pump as was the case in the hereinbefore discussed prior art U.S. Pat. No. 2,828,761. In view of this, the apparatus of the present invention is well suited for use in either pump-type or pumpless evaporative coolers.

In pump-type evaporative coolers, the cooler's water supply is contained within a single relatively large sump which is formed by the floor pan of the cooler's cabinet. The apparatus of the present invention can be installed in this type of structure by simply mounting the special siphon drain valve in the usual outlet opening provided in the floor pan and mounting the means for positively priming the siphon drain valve at any convenient location on or in the cooler cabinet. In this manner, when the apparatus is operated, it will drain, flush and refill the sump in the manner hereinbefore described. Alternately, the special siphon drain valve of the apparatus of the present invention may be mounted in a relatively small reservoir tank located below an opening provided in the floor pan of the cooler to reduce the quantity and surface area of the cooler's operating water supply.

In pumpless type evaporative coolers, the water supply is usually contained within trough-shaped sumps with one such structure being located below each of the movable pads. The trough-shaped sumps are connected to each other by a suitable conduit and are provided with a single float controlled fresh water inlet valve and a single drain outlet. Since the plural trough-shaped sumps are interconnected, the mounting of the special siphon drain valve of the apparatus of the present invention in the single outlet will provide the beneficial function for all of the plural sumps. And, as in the pump-type cooler described above, the means for positively priming the siphon drain valve may be mounted in any convenient location in or about the cooler's cabinet.

Accordingly, it is an object of the present invention to provide a new and improved automatic flushing and draining apparatus for use in evaporative coolers.

Another object of the present invention is to provide a new and improved flushing and draining apparatus for use in evaporative coolers which has a flushing, draining and water replacement operational mode that is employed at desired time intervals to flush the cooler and replace its contaminated saline water supply with fresh water, to reduce premature component failures, scaling, calcification and rusting of the cooler.

Another object of the present invention is to provide a new and improved automatic flushing and draining apparatus for use in evaporative coolers, which has a draining operational mode that is used to drain the contaminated saline water supply from the evaporative cooler when its operation is being terminated.

Another object of the present invention is to provide an apparatus of the above described character which may be manually operated or may be under control of a suitable timing device.

Another object of the present invention is to provide an apparatus of the above described character which is self-sufficient in that is does not rely on any component or operational occurence of the evaporative cooler for its operation and is thus suitable for use in any type of evaporative cooler.

Another object of the present invention is to provide an apparatus of the above described character which includes a special siphon drain valve and means for positive priming thereof at predetermined intervals.

Another object of the present invention is to provide an apparatus of the above described type wherein the special siphon drain valve is provide with an injector means for receiving water under pressure and utilizing it for positive priming of the siphon drain valve.

Another object of the present invention is to provide an apparatus of the above described type wherein the means for positive priming of the siphon drain valve includes a container coupled to receive and store water under pressure and a solenoid operated shutoff valve which directs the stored water under pressure to the siphon drain valve upon energization of the solenoid valve.

Another object of the present invention is to provide an apparatus of the above described character wherein the container of the means for positive priming of the siphon drain valve is provided with an anti-siphon valve.

Another object of the present invention is to provide an apparatus of the above described type wherein the solenoid is operated at predetermined time intervals by a timing means.

Another object of the present invention is to provide an apparatus of the above described character wherein the timing means may include means for sensing the cooler's water evaporation rate and increasing the frequency of operation of the solenoid operated shutoff valve in response to a decreasing evaporation rate.

The foregoing and other objects of the present invention as well as the invention itself may be more fully understood from the following description when read in conjunction with the accompanying drawings.

DESCRIPTION OF THE PREFERRED EMBODIMENTS

Figure 1:
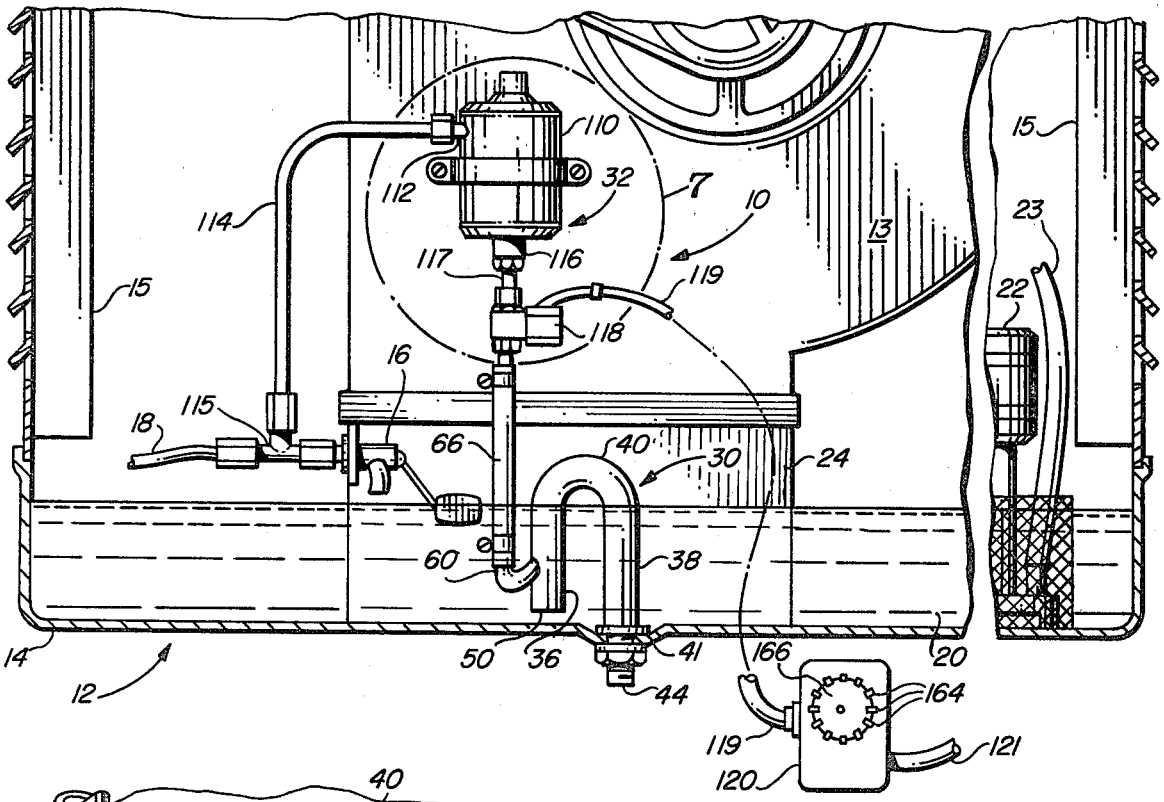
FIG. 1 is a fragmentary sectional view taken on a vertical plane through a typical evaporative cooler and showing the preferred embodiment of the apparatus of the present invention mounted within the cooler.

Referring more particularly to the drawings, FIG. 1 shows the preferred embodiment of the automatic flushing and draining apparatus of the present invention, with that apparatus being indicated generally by the reference numeral 10.

Before describing the apparatus 10 in detail, it is deemed advisable to briefly discuss the illustrated evaporative cooler, which is indicated generally by the reference numeral 12, to insure a complete understanding of the operation and usefullness of the apparatus 10. The illustrated evaporative cooler 12 is typical of the general class of coolers herein referred to as pump-type coolers.

The evaporative cooler 12 includes, among other things, the usual air moving blower assembly 13, a floor pan 14, wettable cooler pads 15, a float controlled fresh water inlet valve 16 which receives water under pressure, such as from a municipal water supply pipeline 18, for initially providing an operating water supply 20 and to supply make-up water as needed to replace that lost due to the evaporation process. An electrically operated pump 22 is utilized to draw water from the supply 20 and direct it through a water distribution plumbing network 23 to the tops of each of the wettable cooler pads 15. The water will trickle down through the pads under the influence of gravity for wetting thereof, and the unevaporated water will return to the water supply 20 for recirculation. When the air moving blower assembly 13 is operating, it will exhaust air from the cooler's cabinet to a point of use through the blower's outlet 24 and in doing so, a negative static pressure results within the cabinet. This causes ambient air to be drawn into the cooler through the wet cooler pads and this causes a reduction in the sensible temperature of both the air and the water in accordance with the well known principles of evaporation.

It is to be understood that the evaporative cooler 12 shown in FIG. 1 and described above was included herein simply to show the environment in which the apparatus 10 of the present invention operates and is not intended as a limitation of the invention. As will become apparent as this description progresses, the apparatus 10 is a self-sufficient mechanism which may therefore be employed in any type of evaporative cooler, such as those of the hereinbefore discussed pump-type and pumpless classes.

The automatic flushing and draining apparatus 10 of the present invention includes a special siphon drain valve means 30, and means 32 for positively priming the siphon drain valve.

Figure 2:
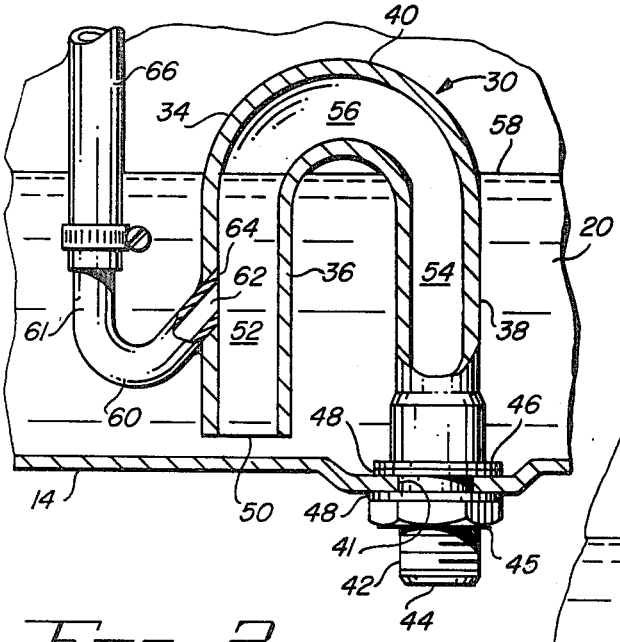
FIG. 2 is a fragmentary sectional view taken on a vertical plane through the preferred embodiment of the special siphon drain valve means of the apparatus of the present invention.

As seen best in FIG. 2, the preferred embodiment of the special siphon drain valve means 30 includes a tubular body 34 of inverted U-shaped configuration which defines a water inlet leg 36, a water outlet leg 38 with an arcuate bight portion 40 therebetween. The water outlet leg 38 is suitably mounted in the usual drain outlet opening 41 provided in the bottom of the cooler's floor pan 14 so as to be upstanding and to extend therethrough. The outlet leg 38 is provided with external threads 42 or other means by which a drain line, or hose, (not shown) may be connected to the outlet end 44 of the siphon drain valve. Those same threads 42 carry a nut 45 which, in conjunction with a fixed flange 46 carried fast on the outlet leg 38 compressively holds suitable gaskets 48 in leakproof engagement with the opposite surfaces of the floor pan 14 about the outlet opening 41 thereof. Such mounting of the tubular body 34 places the arcuate bight portion 40 in upwardly spaced relationship with respect to the bottom of the floor pan 14, with both the inlet and outlet legs 36 and 38 respectively in normal relationship with the bottom of the floor pan. The water inlet end 50 provided on the inlet leg 36 of the tubular body 34 is spaced upwardly from the bottom of the floor pan 14, but is in close proximity thereto for reasons which will become apparent as this description progresses. With the tubular body 34 configured and mounted as described, the bore thereof defines a water inlet passage 52, a water outlet passage 54 with a water passage zone 56 therebetween. The siphon drain valve 30 is sized so that the water passage zone 56 is located above the water level 58 of the cooler's water supply 20 and therefore, the siphon drain valve will normally be in the unprimed state.

The special siphon drain valve 30 is primed by injecting water under pressure into the water inlet passage 52 thereof toward the water passage zone 56 to flood that zone and thus prime the siphon drain valve.

Therefore, the siphon drain valve 30 includes injector means which in this embodiment is an arcuate tube 60 of substantially U-shaped configuration having a water inlet end 61 and a water outlet end 62. The tube 60 is welded, soldered or otherwise mounted on the water inlet leg 36 of the tubular body 34 of the siphon drain valve so that its outlet end 62 is carried in an opening 62 formed therein. The opening 64 is angularly disposed with respect to the longitudinal axis of the inlet leg 36 of the tubular body 34 so that the outlet end 62 of the tube will inject water under pressure upwardly and angularly into the water inlet passage 52 toward the water passage zone 56. The water inlet end 61 of the injector tube 60 is coupled, such as by means of a suitable hose 66, to receive water under pressure from the positive priming means 32 as will hereinafter be described in detail.

Figure 3:
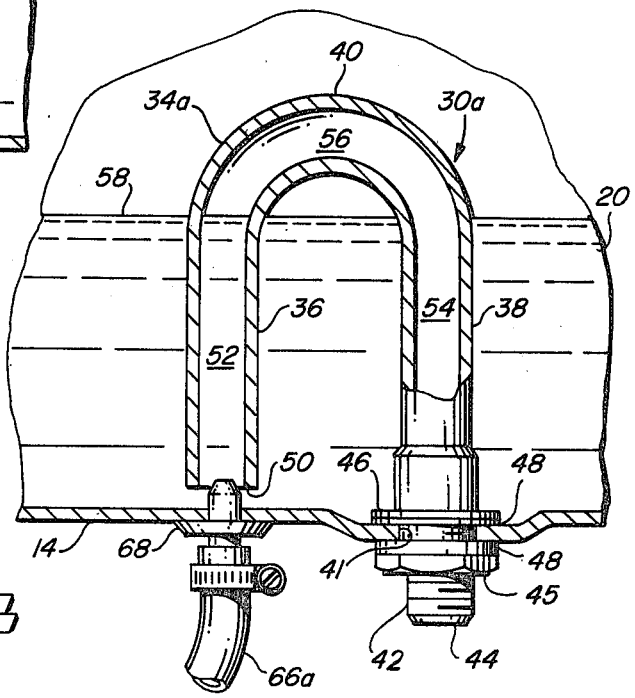
FIG. 3 is a view similar to FIG. 2 and showing a second embodiment of the special siphon drain valve means.

Reference is now made to FIG. 3, wherein a second embodiment of the special siphon drain valve is shown with this embodiment being indicated generally by the reference numeral **30*a*. The siphon drain valve 30*a* includes the inverted U-shaped tubular body 34*a* which is identical to the previously described tubular body 34 with the exception that the opening 64 of the body 34 is not provided in the tubular body 34*a***. Thus, the tubular body 34*a* includes the water inlet leg 36, the water outlet leg 38 and the arcuate bight portion 40, which define the water inlet passage 52, the water outlet passage 54 and the water passage zone 56 respectively. And, as shown, the tubular body 34*a* is oriented, sized and mounted in the floor pan 14 of the cooler in the same manner as the previously described tubular body 34. The injector means of this embodiment of the special siphon drain valve 30*a* is in the form of an injector nozzle 68 which is fixedly mounted in the floor pan 14 immediately below the water inlet end 50 of the tubular body 34*a*. The injector nozzle 68 extends normally and upwardly from the surface of the floor pan 14 to position its water outlet end proximate the water inlet end 50 so that when water under pressure is supplied to its depending end from the positive priming means 32, such as by means of the hose 66*a*, the water is injected axially into the water inlet passage 52 toward the water passage zone 56 and will thus positively prime the siphon drain valve 30*a*.

Figure 4:
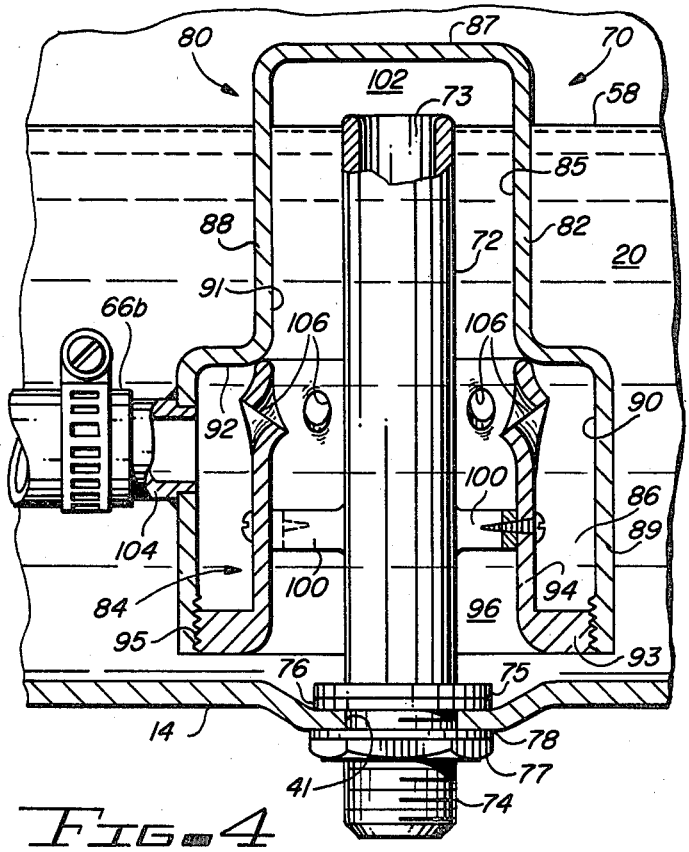
FIG. 4 is a view similar to FIG. 2 and showing a third embodiment of the special siphon drain valve means.

Referring now to FIG. 4 wherein another type of special siphon drain valve is shown with this embodiment being indicated in its entirety by the reference numeral 70.

The siphon drain valve 70 includes a standpipe 72 having an open top 73 and having its open lower end externally threaded as at 74. The standpipe 72 is molded or otherwise formed with an annular flange 75 immediately above the threaded end 74 thereof. The depending threaded end 74 passes through the drain outlet opening 41 of the floor pan 14 with a sealing gasket 76 interposed between the downwardly facing surface of the annular flange 75 and the upwardly facing surface of the floor pan 14. A nut 77 and sealing gasket 78 are carried on the threaded end 74 of the standpipe 72 and are employed to mount the standpipe in a leak proof upstanding manner in the floor pan 14.

The siphon drain valve 70 also includes a downwardly opening cylindrical cap assembly 80 which is coaxially disposed about the standpipe 72 and is fixedly attached thereto, as will hereinafter be described in detail, so that the open upper end 73 of the standpipe 72 is spaced downwardly from the closed upper end or top of the cylindrical cap 80.

The downwardly opening cylindrical cap 80 is a two piece assembly including a cap body 82 having a special sleeve 84 mounted in its open bottom end, with the cap body 82 and the sleeve 84 cooperatively providing the cylindrical cap 80 with an axial bore 85 which is closed at the top and open at the bottom. The cap body 82 and the sleeve 84 also cooperatively provide the cap 80 with an injector means in the form of an annular chamber 86 which circumscribes the lower end of the cap 80 and is designed to inject water under pressure into the bore 85 thereof as will hereinafter be described.

The cap body 82 has a closed top 87 with an endless depending skirt 88 which is formed with an enlarged portion 89 at its lower open end so that the skirt defines a relatively large bore 90 at its lower end and a reduced diameter bore 91 at its closed upper end and has an endless shoulder 92 therebetween. The sleeve 84 is formed with an annular flange 93 at its bottom end with a reduced diameter main body portion 94 extending axially upwardly therefrom.

It should be understood that the siphon drain valve 70 may be molded out of a suitable plastic material and in such a case, the sleeve 84 may be fixedly mounted in the cap body 82 such as by using a suitable adhesive. The siphon drain valve 70 is shown as being fabricated of metal and with this type of manufacturing technique, the sleeve 84 is threadingly inserted as indicated at 95 into the relatively large bore 90 provided at the lower end of the cap body 82.

When the sleeve 84 is mounted in the cap body 82 as described above, the bore of the sleeve 84 and the reduced diameter bore 91 of the cap body 82 cooperatively define the axial bore 85 which is coaxial with the standpipe 72 and forms an annular water inlet flow passage 96 of the siphon drain valve 70. The inner surface of the relatively large bore 90 and the endless shoulder 92 of the cap body 82 cooperate with the peripheral surface of the reduced diameter main body portion 94 and the annular flange 93 of the sleeve 84 to form the above mentioned annular chamber 86 of the injector means of this embodiment. The downwardly opening cylindrical cap 80 may be attached to the standpipe 72 in any suitable manner, such as by means of the radial struts 100 which extend from the standpipe 72 and are attached, such as by the illustrated sheet metal screws, to the bore of the sleeve 84. This mounting is accomplished in a manner which positions the closed upper end of the cylindrical cap 80 in upwardly spaced relationship with respect to the open top 73 of the standpipe, with the space therebetween providing the siphon drain valve 70 with a water passage zone 102. The siphon drain valve 70 is sized so that the water passage zone 102 thereof is above the normal water level 58 of the cooler's operating water supply 20, so that the siphon drain valve 70 will normally be in its unprimed state.

The cap body 82 of the downwardly opening cylindrical cap 80 is provided with a boss 104, the bore of which opens into the annular chamber 86 formed on the cylindrical cap. Water under pressure from the means 32 (FIG. 1) for positively priming the siphon drain valve, is coupled to the boss 104 and thus is admitted to the annular chamber 86 by a suitable conduit such as the hose 66*b*. The annular chamber 86 provided on the cylindrical cap 80 is in communication with the annular water flow passage 96 by means of a plurality of apertures 106 formed through the reduced diameter main body portion 94 of the sleeve 84. The apertures 106 are formed in spaced increments about the periphery of the sleeve body portion 94 and are each formed so as to extend angularly upwardly and inwardly from the annular chamber 86 into the annular water inlet flow passage 96. It will now be seen that when water under pressure enters the annular chamber 86, it will be injected upwardly into the annular water flow passage 96 toward the water passage zone 102 and will flood that zone for positive priming of the siphon drain valve 70.

Referring once again to FIG. 1 wherein the mounting and hook-up of the means 32 for positively priming the siphon drain valve is best shown.

As will hereinafter be described in detail, the preferred embodiment of the positive priming means 32 includes a charging vessel 110 having an inlet boss 112 which is coupled by a suitable conduit 114 to a tee fitting 115 mounted in the water supply pipeline 18 upstream of the float controlled fresh water inlet valve 16 of the evaporative cooler 12. The charging vessel 110 has an outlet boss 116 which is coupled by a suitable conduit 117 to a normally closed solenoid operated shutoff valve 118 which is in turn coupled by the hereinbefore mentioned hose 66 to the siphon drain valve means 30. The solenoid operated shutoff valve 118 is connected by suitable conductors 119 to a timing means 120 which is in turn provided with a suitable power cord 121 which is for connection to a suitable source of electric power (not shown).

Figure 7:
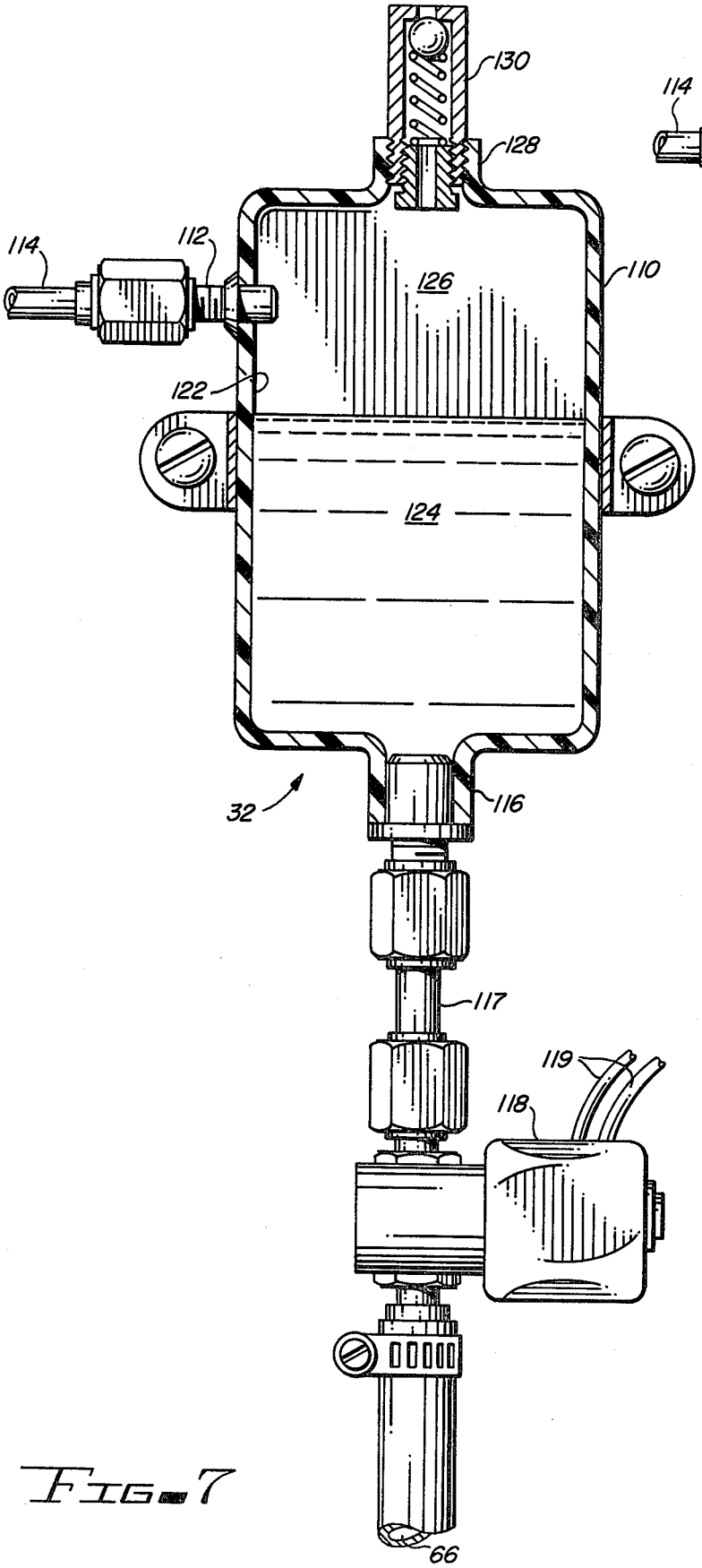
FIG. 7 is an enlarged sectional view of that portion of FIG. 1 which is encircled by dashed lines and showing the preferred embodiment of the means for positively priming the special siphon drain valve means.

The preferred form of the charging vessel 110 is best illustrated in FIG. 7, wherein the vessel is seen as a bottle shaped structure which defines an internal charging chamber 122 into which water under pressure is supplied via the conduit 114. The incoming water will flow freely into the chamber 122 until such time as the entrapped air becomes pressurized to a point where it substantially matches that of the line pressure in the water supply pipeline 18. When such pressure equalization is achieved, the charging vessel 110 will contain a quantity of water 124 under pressure in the lower portion thereof and a quantity of compressed air 126 in the upper portion thereof.

When the solenoid operated valve 118 is energized to move it from its normally closed state to an open position, the water 124 will flow under pressure through the tube 117, through the solenoid operated shutoff valve 118, through the hose 66 to the injector means 60 of the siphon drain valve means 30 for positive priming thereof as hereinbefore described.

In a typical evaporative cooler installation, the water supply pipeline 18 is a copper tube having an inside diameter of ⅛ inch which is well suited for initial filling and supplying make-up water to the cooler's floor pan. However, in some instances such a limited flow capacity would probably result in failure in achieving the objective of flooding the water passage zone 56 of the siphon drain valve 30, and thus failure to achieve positive priming thereof. The above described charging vessel 110 insures that a sufficient quantity of water under pressure is available for the priming operation, and as shown, the outlet tube 117 and the hose 66 are of larger diameter than the water supply pipeline 18 and the conduit 114 to insure that the water 124 in the charging chamber 122 will flow at a rate which is sufficient to achieve the desired positive priming of the siphon drain valve.

Another boss 128 is provided at the top of the charging vessel 110 and an anti-siphon valve 130 is suitably mounted therein to prevent the water 124 from being siphoned back into the water supply pipeline 18 in the event of a loss, or reduction, in line pressure in the pipeline 18. As shown, the anti-siphon drain valve 130 may be in the form of a normally closed ball-type valve which checks the flow out of the charging chamber 122 and allows airflow into the chamber if the pressure therein should fall below atmospheric pressure.

Figure 8:
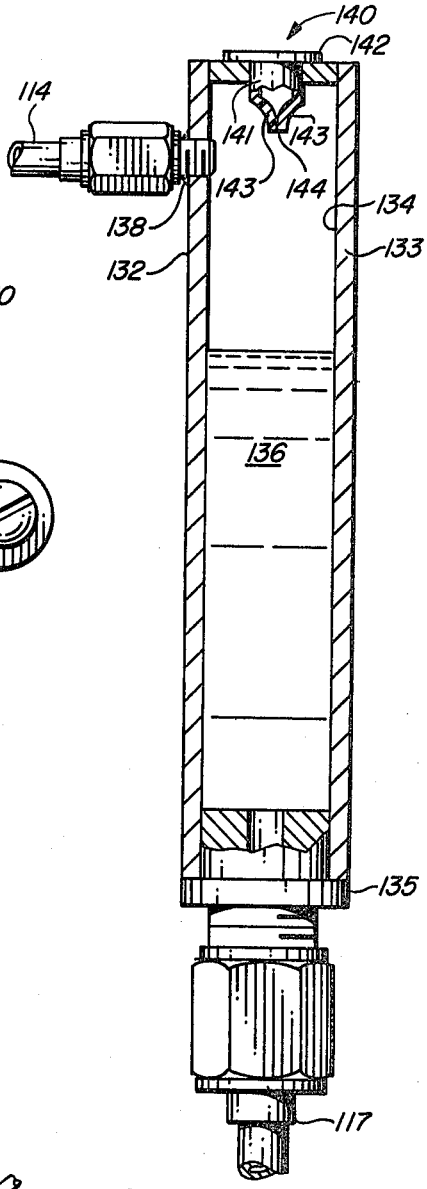
FIG. 8 is a sectional view similar to FIG. 7 and showing a second embodiment of the means for positively priming the special siphon drain valve means.

A modified form of charging vessel 132 is shown in FIG. 8 as being in the form of a relatively large diameter conduit 133 which defines a charging chamber 134. The lower end of the conduit 133 is closed by a suitable fitting 135 which is the outlet to which the tube 117 is connected to deliver the pressurized water supply 136 to the solenoid operated shutoff valve 118 (FIG. 1) as hereinbefore described. An inlet fitting 138 is mounted in the charging vessel 132 adjacent the upper end thereof and the conduit 114 is connected to that fitting for supplying water to the charging vessel 132. The charging vessel 132 will function in exactly the same manner as the hereinbefore fully described charging vessel 110. In addition to the configuration differences, the charging vessel 132 is provided with a different type of anti-siphon valve 140.

The anti-siphon valve 140 is in the form of a sleeve-like substantially cylindrical body 141 molded or otherwise formed of a resilient material, such as rubber. An endless shoulder 142 is formed on one end of the body 141 and an opposed pair of substantially flattened converging flap members 143 on the other end. The flap members define a slit 144 at their junction which is closed when the pressure on the exterior of the flap members is greater than the pressure within the bore of the cylindrical body. Thus, when the valve 140 is mounted as shown in the upper end of the charging vessel 132, atmospheric pressure will be present in the valve's bore and the relatively higher pressure within the charging chamber 134 will hold the flap members 143 closed. In the event that the pressure within the charging chamber 134 falls below atmospheric pressure, air will be drawn into the charging chamber and thus prevent siphoning of the water 136 therein back into the supply line 18.

Differential pressure valves of the above described type are commercially available products commonly referred to as duckbill valves, and may be obtained from Varnay Laboratories, Inc. of Yellow Springs, Ohio 45387, and a particular one of such valves is identified as Duckbill, VA 3444.

Figure 9:
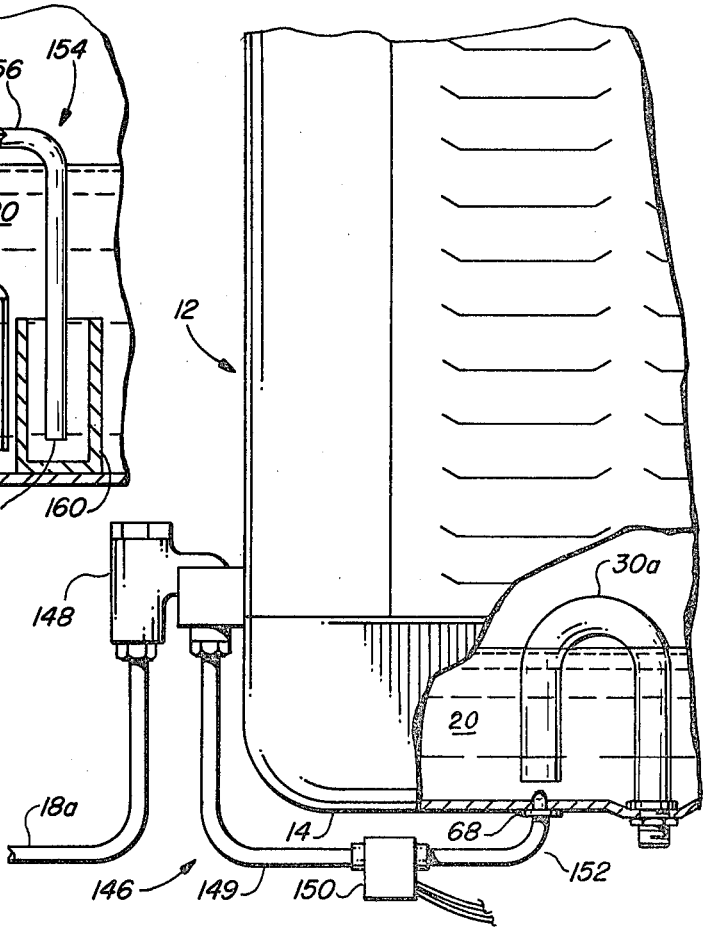
FIG. 9 is a diagramatic illustration showing another means for positively priming the special siphon drain valve means.

As hereinbefore mentioned, the charging chambers 110 and 132 are provided to insure that a sufficient quantity of water is available at the desired flow rate for achieving positive priming of the siphon drain valve 30. In some installations of evaporative coolers, the typical previously discussed water supply pipeline 18 having a small inside diameter may not be used, and such a pipeline 18*a* (FIG. 9) of larger inside diameter may be used instead. In this and similar installations, a simplified form of means 146 for positively priming the siphon drain valve may be used such as that shown in FIG. 9. The siphon drain valve 30*a*, or one of the other embodiments 30 or 70, is mounted in the floor pan 14 of the cooler 12 in the above described manner. The larger diameter water supply pipeline 18*a* is directed from a suitable source of water under pressure (not shown) to the inlet of a conventional anti-siphon valve 148 which is suitably mounted on the cooler 12. The outlet of the anti-siphon valve 148 is coupled by a conduit 149 to the inlet of shutoff valve means 150, and the outlet of that valve is coupled by a conduit 152 to the injector nozzle 68 of the siphon drain valve 30*a*. The shutoff valve means 150 may be in the form of the previously described solenoid operated shutoff valve 118, or may be a simple manually operated gate valve (not shown).

The operation of the apparatus 10 of the present invention may be obvious from the foregoing description however, a brief operational description will now be presented to insure a complete understanding.

When the evaporative cooler 12 is placed in operation, the floor pan 14 will be supplied with its operating water supply 20 in the conventional manner and the charging vessel 110 will be supplied with the water 124 (FIG. 7) as hereinbefore described. When the cooler's operating water supply 20 becomes contaminated, the solenoid operated valve 118 is energized to switch the apparatus 10 to its flushing, draining and water replacement operational mode by positive priming of the siphon drain valve 30. When primed, the siphon drain valve will empty the floor pan 14 of the cooler and the siphon drain valve will automatically loose its prime when the water level within the floor pan falls below the water inlet end 50 of the siphon drain valve. With the siphon drain valve returning to its normal unprimed state, the floor pan 14 will be refilled with fresh water supplied thereto through the float controlled fresh water inlet valve 16.

It will be seen that at some relatively short time after the siphon drain valve is primed, the float controlled fresh water inlet valve 16 will open to admit water to the floor pan 14 and therefore, the fresh water will be entering the floor pan simultaneously with emptying thereof by the siphon drain valve. This results in the beneficial action of flushing and rinsing the floor pan, and other components of the cooler if the cooler is operational. However, a size relationship must exist between the incoming water supply lines and that of the siphon drain valve to insure that the floor pan will drain at a faster rate than the incoming water flow rate for, in the absence of such a size relationship, the siphon drain valve would not loose its prime and a continuous flow of water through the cooler would result. Thus, for proper operation, the siphon drain valve 30 must be of larger diameter than the water supply pipeline 18.

To insure that a positive interruption occurs, i.e., the siphon drain valve looses its prime at the proper time, a means for positively interrupting operation of the siphon drain valve may be provided in cooler installations wherein reliable automatic interruption is questionable. Such questionable automatic interruption may occur as the result of the water supply pipeline 18 being larger than normal as mentioned above, and may also result with a properly sized water supply pipeline when the line pressure therein is above normal.

Figure 5:
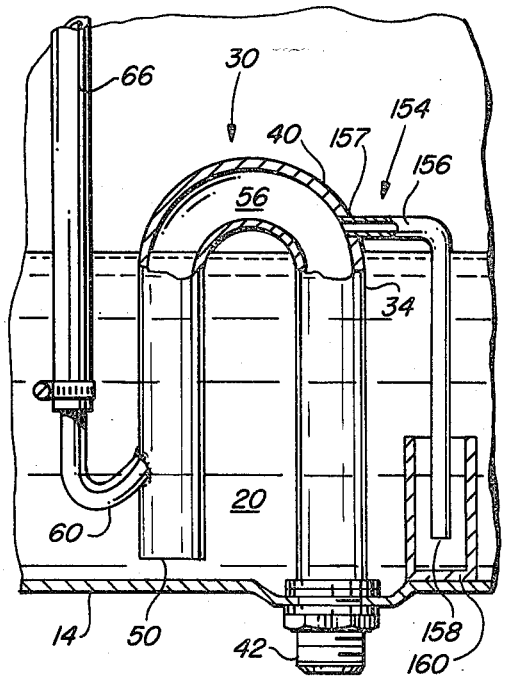
FIG. 5 is a view similar to FIG. 2 and showing the siphon drain valve means of that embodiment as being provided with a mechanism for positively interrupting operation of the siphon drain valve when drainage of the cooler's sump is completed.

In any event, the positive interruption means 154 may be provided on the siphon drain valve 30, as shown in FIG. 5. A tube 156 is connected to the bight portion 40 of the tubular body 34 so that one of its ends as indicated at 157 opens into the water passage zone 56 of the siphon drain valve. The tube 156 is configured so that its opposite end 158 is disposed within a suitable open top container 160 supportingly carried in the floor pan 14 of the cooler. When the floor pan contains the cooler's operating water supply 20, the open top container will be full of water. When the siphon drain valve 30 is primed, the water 20 will be flowing through the tubular body 34, as described above, and will also flow through the tube 156 into the water passage zone 56 and will thus be drained from the floor pan. When the water level falls below the top of the open container 160, the water in the container will continue to flow out through the tube 156 and when the water level in the container falls below the end of the tube, air will be drawn into the tube and delivered to the water passage zone 56, thus interrupting the siphoning action. The incoming fresh water may possibly prevent siphon interruption from taking place at the water inlet end 50 of the siphon drain valve 30, but since the incoming fresh water cannot refill the open top container 160 due to the upstanding endless sidewall thereof, positive siphon interruption will occur.

Figure 6:
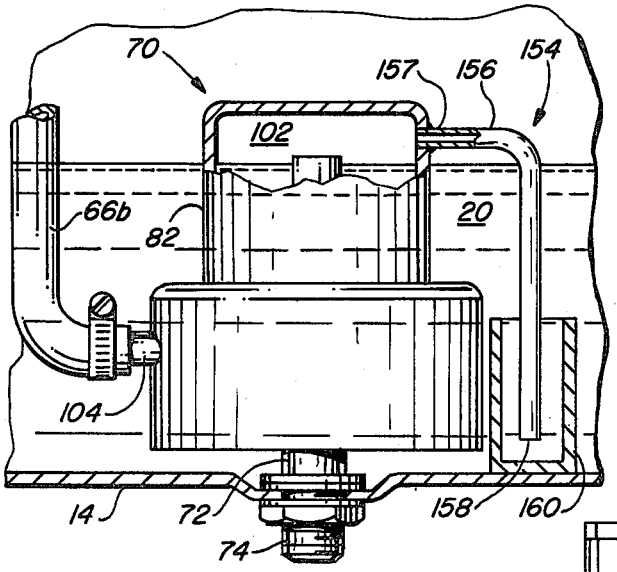
FIG. 6 is a view similar to FIG. 4 and showing the siphon drain valve means of that embodiment as being provided with a mechanism for positively interrupting operation of the siphon drain valve when drainage of the cooler's sump is completed.

Although the positive siphon interrupt means 154 is shown in FIG. 5 and described above as being mounted on the siphon drain valve 30, it will be understood that the exact same means 154 may be used in conjunction with the siphon drain valve 30*a*. Likewise, the siphon drain valve 70 may be similarly equipped in the manner shown in FIG. 6. In this latter case, the end 157 of the tube 156 is mounted fast on the closed top 87 of the downwardly opening cylindrical cap assembly 80 so as to open into the water passage zone 102 thereof. The other end 158 is disposed within the open top container 160 carried in the floor pan 14 and thus, operation will be in the hereinbefore described manner.

The above described operational mode of the apparatus 10 may be altered somewhat to a draining operational mode to drain the water supply 20 from the cooler 12 upon termination of its operation. This is accomplished by simply turning off the water supplied to the pipeline 18 to prevent refilling thereof.

The above described apparatus 10 may be actuated to its flushing, draining and refilling operational mode by manually energizing the solenoid operated shutoff valve 118. However, it is preferred that the apparatus 10 be actuated at predetermined and dependable time intervals and this is ideally accomplished by the timing means 120 shown in FIG. 1 as a conventional time clock.

As is known, a plurality of operational lugs 164 may be installed on the rotating plate 166 of the time clock 120 so that as each of those lugs are sequentially rotated into engagement with an internal switch (not shown) of the time clock, the switch will be moved from its normally closed state to a temporarily open state and will automatically return to its normally closed state when the lug moves out of engagement with the switch. Therefore, if twelve operational lugs 164 for example, are mounted in equally spaced increments about the periphery of the rotating plate 166, and the plate makes one complete revolution in a 24 hour period, the apparatus 10 will be switched to its flushing, draining and refillng operational mode every two hours.

By automatically flushing, draining and replacing the evaporative cooler's water supply at predetermined time intervals, cooler contamination resulting from mineral build-up, airborne contaminants, and the like will be eliminated, or at least substantially reduced. There are times however during the normal operational season of evaporative coolers, when the frequency of switching the apparatus 10 into its flushing, draining and refilling operational mode should be varied in accordance with atmospheric conditions.

As is known, the atmospheric conditions of temperature and relative humidity are factors which determine the water evaporation rate of an evaporative cooler. For example, an evaporative cooler delivering 4000 C.F.M. of evaporatively cooled air with an ambient air temperature of 105° F. and relative humidity of 10%, the water evaporation rate will be about 15.2 gallons per hour. The same cooler delivering 4000 C.F.M. with the ambient air being at 105° F. and a relative humidity of 45%, the water evaporation rate will be about 7.4 gallons per hour. In these two cases, as in all cases, the evaporative cooler will automatically replace the evaporated water with make-up water by means of the float controlled fresh water inlet valve 16.

Most municipal and other water supplies are treated at water purification facilities and one of the things accomplished at most such facilities is the addition of a bacteriacidal chemical to the water supply, and the chemical is usually chlorine. When the rate of evaporation in a cooler is relatively high, as in the first example given above, the amount of make-up water supplied to the cooler will result in a relatively large and virtually constant flow of chlorinated water into the cooler. When the cooler's evaporation rate is low, as in the second example given above, the flow of chlorinated water into the cooler will be substantially reduced.

As hereinbefore described, evaporative coolers will sometimes emit offensive odors and this is attributed to bacteria growth within the cooler. When the water evaporation rate is high, the amount of incoming chlorinated make-up water, along with a suitable frequency rate of operation of the apparatus 10, will eliminate, or at least substantially reduce, the odor and bacteria problem. The frequency rate of operation of the apparatus 10 will vary in accordance with such factors as water quality in a specific area and the like. For purposes of this description, a suitable frequency rate will be assumed as being at two hour time intervals and this is easily accomplished by installing twelve of the lugs 164 on the rotating plate 166 of the time clock 120 as hereinbefore described.

From the above description it will be seen that when the water evaporation rate declines as a result of atmospheric conditions, the amount of incoming chlorinated make-up water will be reduced. In the two examples given above, the amount of chlorinated make-up water in the second example is half of that supplied in the first example. Therefore, it is desirable to increase the frequency rate of operation of the apparatus 10 when the atmospheric conditions produce a decline in the amount of chlorinated make-up water being supplied to the evaporative cooler to insure against offensive odors and bacteria growth therein.

Figure 10:
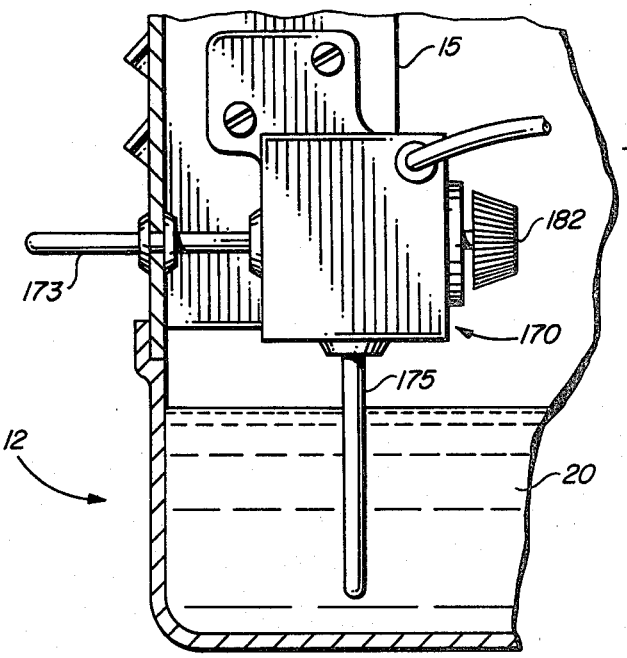
FIG. 10 is a fragmentary sectional view showing the mounting of a means for sensing the evaporation rate of the cooler.
Figure 11:
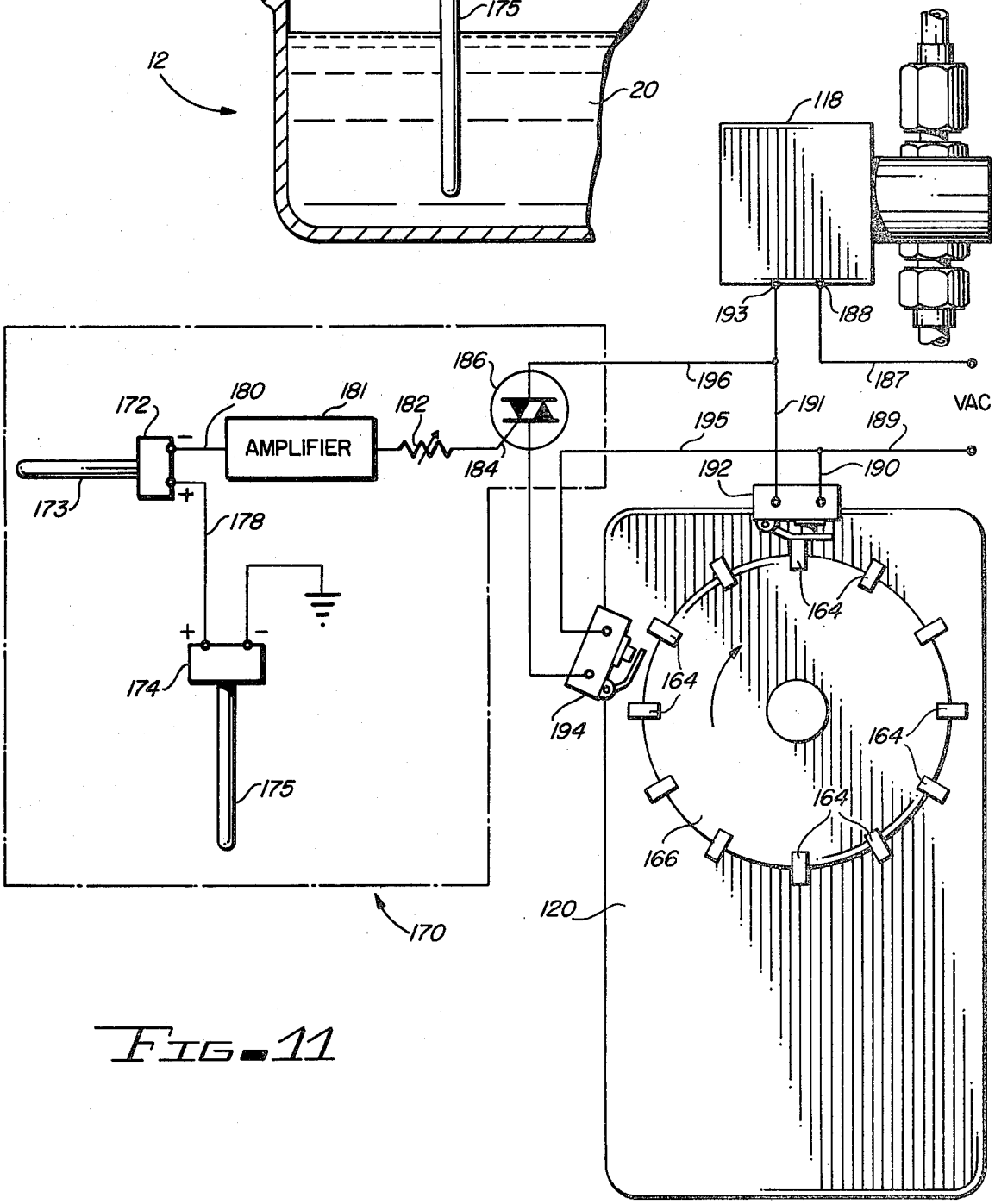
FIG. 11 is a diagramatic view of the means for sensing the evaporation rate of the cooler and utilizing the sensed information in conjunction with a timing means to control the flushing and draining frequency of operation of the apparatus of the present invention.

Referring now to FIGS. 10 and 11 wherein an evaporation rate sensor means 170 is shown along with electrical circuitry which increases the frequency rate of operation of the apparatus 10 when the rate of water evaporation falls below an adjustably predetermined level.

The evaporation rate sensor means 170 may be mounted in any suitable manner such as that illustrated in FIG. 10 wherein the sensor is mounted on the depending end of one of the cooler pads 15 of the cooler 12.

The evaporation rate sensor 170 includes a first sensor means in the form of a thermocouple 172 the probe 173 of which extends from the sensor 170 so as to be capable of sensing dry bulb temperature, i.e., ambient air temperature outside the cooler's cabinet, and produce an electric signal indicative of the value of the dry bulb temperature. A second sensor means in the form of a thermocouple 174 is disposed so that its temperature sensing probe 175 extends from the sensor 170 so as to be emersed in the operating water supply 20 of the cooler and will thus sense wet bulb temperature and produce an electric signal indicative of the value of the wet bulb temperature. Since the two thermocouples 172 and 174 are sensing the two factors which determine relative humidity, the difference between the two sensed temperatures are indicative of the rate of water evaporation.

The thermocouples 172 and 174 are electrically coupled to each other as shown in FIG. 11, with the negative therminal of the thermocouple 174 being connected to ground with the positive therminal thereof being connected to the positive therminal of the thermocouple 172 by the conductor 178, and the negative terminal of the thermocouple 172 thus provides a resultant voltage which is the differential voltage output of the thermocouples. The resultant voltage is present on a conductor 180. The conductor 180 has a suitable amplifier 181 therein which amplifies the resultant output signal to a usable value, and the conductor 180 also has a variable resistor 182 therein which is employed as an adjustable threshold determining device. Therefore, amplified resultant signals having a differential voltage value below the adjustable threshold will be dissipated by the variable resistor 182, and the resultant signals having a differential value above the adjustable threshold will be applied to the grid 184 of a triac 186 to render the triac conductive.

As hereinbefore described, the time clock 120 has the usual rotating plate 166 with the twelve lugs 164 mounted thereon in the usual well known manner.

Electric power from a suitable source (not shown) is coupled by a conductor 187 directly to one terminal 188 of the solenoid valve 118 of the apparatus 10 and by the conductors 189, 190 and 191 through a first normally open switch 192 to the other terminal 193 of the solenoid valve. When the triac 186 is in its normal non-conductive state, indicative of a high rate of evaporation, the first switch 192 will be closed each time one of the lugs 164 is moved into engagement with the first switch, and when so closed, the first switch will complete the circuit to the solenoid valve 118 and thereby actuate the apparatus 10. In the above given example, this will occur every two hours.

To increase the operational frequency rate of the apparatus 10 as is desired when the rate of evaporation decreases, a second normally open switch 194 is suitably mounted in the time clock 120. This second switch is connected by means of the conductor 195 to the power supply conductor 189, and by means of the conductor 196 through the triac 186 to the terminal 193 of the solenoid valve 118. Thus, the first and second switches 192 and 194 are wired in parallel so that closing of either one of those switches will complete the circuit to the solenoid valve 118.

The first and second switches 192 and 194 are physically mounted in an offset relationship so that when one of those switches is closed, the other will be open. In other words, when for example, the switch 192 is being actuated to its closed state, as shown, by one of the lugs 164, the other switch 194 is halfway between another spaced pair of the lugs 164.

When the triac 186 is in its conductive state, indicative of a relatively low water evaporation rate, the solenoid valve 118 will be alternately actuated by the two switches 192 and 194 at twice the frequency rate of that provided by the switch 192 alone. In the given example, the apparatus would thus be actuated, or operated, once every two hours when the rate of evaporation is high and would be actuated, or operated, every hour when the rate of evaporation falls below the adjustably predetermined value.

It will be understood that the above described evaporation rate sensor and its associated electrical circuitry can be modified to achieve virtually any desired frequency rate for operation of the apparatus 10. For example, plural switches (not shown) can be appropriately provided in the time clock 120 and electrically coupled in parallel relationship with respect to the illustrated switches 192 and 194, and by providing those additional switches with the necessary electrical components, in the manner hereinbefore described, in their respective parallel circuits, the frequency rate of operation of the apparatus 10 can be made to increase in proportion to the decrease in water evaporation rate.

While the principles of the invention have now been made clear in illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. An automatic flushing and draining apparatus for an evaporative cooler comprising:

(a) an evaporative cooler having a sump means for containing a water supply which is used in the operation of said evaporative cooler and having means for maintaining the water supply at a predetermined operating level within said sump means, said sump means having an outlet opening in the bottom thereof;

(b) siphon drain valve means mounted in the outlet opening of said sump means and having a water inlet opening adjacent the bottom of said sump means with a water inlet passage extending from the water inlet opening to a water passage zone which is disposed above the operating water level of said sump means;

(c) injector means for receiving water under pressure and injecting it into the water inlet passage of said siphon drain valve means toward the water passage zone for flooding thereof; and (d) positive priming means connected between an external source of water under pressure and said injector means, said positive priming means having a first state which prevents the flow of water under pressure to said injector means and a second state which allows the flow of water under pressure to said injector means.

2. An automatic flushing and draining apparatus as claimed in claim 1 wherein said siphon drain valve means comprises an inverted U-shaped tube having a bight portion which defines the water passage zone of said siphon drain valve means and having a water outlet leg depending from one side of said bight portion with means on the depending end of said water outlet leg by which said inverted U-shaped tube is mounted in the outlet opening of said sump means of said evaporator cooler, said inverted U-shaped tube having a water inlet leg depending from the other end of said bight portion and defining the water inlet passage of said siphon drain valve means, said water inlet leg being open at the bottom to provide the water inlet opening of said siphon drain valve means and is shorter than said water outlet leg to space the water inlet opening thereof above the bottom of said sump means of said evaporative cooler.

3. An automatic flushing and draining apparatus as claimed in claim 2 wherein said injector means is mounted on said water inlet leg of said inverted U-shaped tube, said water inlet leg having at least one opening formed therein which is in communication with said injector means.

4. An automatic flushing and draining apparatus as claimed in claim 2 wherein said injector means comprises:

(a) said water inlet leg of said inverted U-shaped tube having an aperture formed in the sidewall thereof; and (b) an injector tube one end of which is affixed to the sidewall of said water inlet leg so as to be in communication with the aperture formed therein, said injector tube being formed so that the one end thereof is disposed at an upwardly sloping angle with respect to the axis of said water inlet leg.

5. An automatic flushing and draining apparatus as claimed in claim 2 wherein said injector means comprises an injector nozzle mounted in the bottom of said sump means immediately below the water inlet opening provided at the bottom of said water inlet leg of said inverted U-shaped tube.

6. An automatic flushing and draining apparatus as claimed in claim 1 wherein said siphon drain valve means comprises:

(a) a standpipe mounted in the outlet opening provided in the bottom of said sump means and upstanding therefrom, said standpipe having an open upper end; and (b) a cylindrical cap coaxial with said standpipe and having a closed top which is spaced above the open upper end of said standpipe to form the water passage zone of said siphon drain valve means, said cylindrical cap having an endless skirt integrally depending from its closed top with an inside diameter which is larger than the outside diameter of said standpipe to form the water inlet passage of said siphon drain valve means and having an endless bottom edge which defines the water inlet opening of said siphon drain valve.

7. An automatic flushing and draining apparatus as claimed in claim 6 wherein said injector means comprises:

(a) means on the depending skirt of said cylindrical cap for forming a circumscribing annular chamber:

(b) inlet means on said means for receiving water under pressure from said positive priming means and admitting it to the annular chamber thereof; and (c) said skirt of said cylindrical cap having plural apertures formed in radially spaced increments about the periphery thereof, each of said apertures extending between the annular chamber formed by said means and the bore of said cylindrical cap.

8. An automatic flushing and draining apparatus as claimed in claim 7 wherein each of said plurality of apertures formed in the skirt of said cylindrical cap is configured to extend angularly upwardly and inwardly from the annular chamber formed by said means into the bore of said cylindrical cap.

9. An automatic flushing and draining apparatus as claimed in claim 6 wherein said injector means comprises:

(a) said cylindrical cap having an enlarged bore formed in the lower end of the skirt thereof;

(b) a sleeve having a bore and mounted in the enlarged bore formed in the lower end of the skirt of said cylindrical cap, said sleeve having an annular flange at its lower end and an upwardly extending reduced diameter body to provide an annular chamber between the lower end of the skirt of said cylindrical cap and the reduced diameter body of said sleeve;

(c) inlet means on the lower end of the skirt of said cylindrical cap for receiving water under pressure from said positive priming means and admitting it to the annular chamber provided between the lower end of the skirt of said cylindrical cap and the reduced diameter body of said sleeve; and (d) said sleeve having a plurality of apertures formed in radially spaced increments in the reduced diameter body portion thereof to extend from the periphery of the reduced diameter body into the bore of said sleeve.

10. An automatic flushing and draining apparatus as claimed in claim 9 wherein each of said plurality of apertures formed in the reduced diameter body of said sleeve is configured to extend angularly upwardly and inwardly into the bore of said sleeve.

11. An automatic flushing and draining apparatus as claimed in claim 9 and further comprising strut means extending between the bore of said sleeve and the periphery of said standpipe for supportingly carrying said sleeve in coaxial relationship with said standpipe.

12. An automatic flushing and draining apparatus as claimed in claim 1 and further comprising means on said siphon drain valve means for admitting air to the water passage zone thereof when the water supply of said evaporative cooler has been drained from said sump means to insure positive interruption of the siphoning action of said siphon drain valve.

13. An automatic flushing and draining apparatus as claimed in claim 1 and further comprising means for positively interrupting the siphoning action of said siphon drain valve, said means including:

(a) said siphon drain valve means having an aperture formed therein so as to open into the water passage zone thereof;

(b) a tube one end of which is fixedly attached to said siphon drain valve means so as to be in communication with the aperture formed therein, said tube having its other end disposed adjacent the bottom of said sump means; and (c) an open top container means supported on the bottom of said sump means and disposed so that the other end of said tube extends into said open top container means, said open top container means having an endless sidewall the upper end of which is above the other end of said tube below the operating level of the water supply in said sump means of said evaporative cooler.

14. An automatic flushing and draining apparatus as claimed in claim 1 wherein said positive priming means includes a pipeline means having a shutoff valve means therein.

15. An automatic flushing and draining apparatus as claimed in claim 14 wherein said shutoff valve means is a normally closed solenoid operated valve.

16. An automatic flushing and draining apparatus as claimed in claim 14 wherein said positive priming means further includes an anti-siphon valve in said pipeline means.

17. An automatic flushing and draining apparatus as claimed in claim 14 wherein said positive priming means further includes a charging vessel in said pipeline means upstream of said shutoff valve means for receiving and containing water under pressure in an amount sufficient to insure flooding of the water passage zone of said siphon drain valve means when said shutoff valve means is opened to supply water under pressure to said injector means.

18. An automatic flushing and draining apparatus as claimed in claim 1 wherein said positive priming means comprises:

(a) an inlet conduit one end of which is connected to the external source of water under pressure;

(b) a charging vessel having a charging chamber formed therein and connected to the other end of said inlet conduit for receiving and containing a supply of water under pressure in the charging chamber thereof, said charging vessel having an outlet boss;

(c) a delivery conduit means coupled between the outlet boss of said charging vessel and said injector means; and (d) a solenoid operated valve in said delivery conduit means, said solenoid operated valve being normally closed to provide the first state of said positive priming means and being actuatable to an open position to provide the second state of said positive priming means.

19. An automatic flushing and draining apparatus as claimed in claim 18 wherein said positive priming means further comprises an anti-siphon valve mounted on said charging vessel.

20. An automatic flushing and draining apparatus as claimed in claim 19 wherein said anti-siphon valve is a check valve which prevents the escape of air from the charging chamber of said charging vessel when the pressure therein is above atmospheric pressure and allows air to flow into the charging chamber of said charging vessel when the pressure therein falls below atmospheric pressure.

21. An automatic flushing and draining apparatus as claimed in claim 1 wherein said positive priming means comprises:

(a) a solenoid operated shutoff valve which is normally closed to provide the first state of said positive priming means and is actuatable to an open position to provide the second state of said positive priming means; and (b) timing means in the power supply line of said solenoid operated shutoff valve for coupling power thereto at a predetermined frequency rate.

22. An automatic flushing and draining apparatus as claimed in claim 21 and further comprising means in said evaporative cooler for sensing the water evaporation rate thereof and increasing the frequency rate at which power is coupled to said solenoid operated shutoff valve when the water evaporation rate falls below a predetermined rate.

23. An automatic flushing and draining apparatus as claimed in claim 21 and further comprising:

(a) said timing means including means for increasing the frequency rate at which power is coupled to said solenoid operated shutoff valve, said means for increasing the frequency rate being normally inoperative and being switchable to an operative state;

(b) first sensing means for sensing the dry bulb temperature and producing an electric signal indicative of the value of the sensed dry bulb temperature;

(c) second sensing means for sensing the wet bult temperature and producing an electric signal indicative of the value of the sensed wet bulb temperature;

(d) circuit means connected to said first and second sensing means to receive the signals therefrom and produce a resultant electric signal indicative of the differential value of the two received signals; and (e) said circuit means connected to said means for increasing the frequency rate of said timing means and switching it to its operative state when the resultant electric signal produced by said circuit means exceeds a predetermined threshold value.

24. An automatic flushing and draining apparatus as claimed in claim 23 wherein said first and said second sensing means are thermocouples.

25. An evaporative cooler comprising in combination:

(a) an evaporative cooler having a sump for containing an operational water supply and having means for supplying the water and maintaining it at a predetermined level in the sump;

(b) a draining apparatus mounted in the sump of said evaporative cooler and being actuatable from a normally inoperative state to an operative state for draining the operational water supply from the sump of said evaporative cooler and returning to its normally inoperative state upon completion of sump drainage;

(c) timing means coupled to said draining apparatus for actuating said draining apparatus, said timing means having a first actuating means for actuating said draining apparatus at a predetermined frequency rate and having a normally inoperative second actuating means which when enabled increases the rate at which said timing means actuates said draining apparatus; and (d) sensing means in said evaporative cooler and coupled to the second actuating means of said timing means, said sensing means for sensing the water evaporation rate and enabling the second actuating means of said timing means when the water evaporation rate is below a predetermined value.

26. An evaporative cooler as claimed in claim 25 wherein said sensing means comprises:

(a) first sensing means for sensing the dry bulb temperature and producing a signal indicative of the value of the dry bulb temperature;

(b) second sensing means for sensing the wet bulb temperature and producing a signal indicative of the value of the wet bulb temperature; and (c) means connected to said first and second sensing means to receive the signals therefrom and produce a resultant signal indicative of the differential value of the two received signals, said means connected to the second actuating means of said timing means for enabling the second actuating means when the resultant signal exceeds a predetermined value.

* * * * *